US005768659A

United States Patent [19]

Kameda

[11] Patent Number: 5,768,659

[45] Date of Patent: Jun. 16, 1998

[54] PROCESS CARTRIDGE AND IMAGE FORMING APPARATUS

[75] Inventor: Seiichiro Kameda, Kawasaki, Japan

[73] Assignee: Canon Kabushiki Kaisha, Tokyo, Japan

[21] Appl. No.: 533,389

[22] Filed: Sep. 25, 1995

[30] Foreign Application Priority Data

Sep. 26, 1994 [JP] Japan ..... 6-229265

[51] Int. Cl.[6] ..... G03G 21/18

[52] U.S. Cl. ..... 399/111; 399/125

[58] Field of Search ..... 399/111, 112, 399/113, 114, 125

[56] References Cited

U.S. PATENT DOCUMENTS 4,500,195 2/1985 Hosono ..... 355/3 R 4,803,521 2/1989 Honda ..... 399/111

5,331,373 7/1994 Nomura et al. ..... 399/111

5,465,136 11/1995 Watanabe ..... 399/111

*Primary Examiner*—R. L Moses

*Attorney, Agent, or Firm*—Fitzpatrick, Cella, Harper & Scinto

[57] ABSTRACT

This invention relates to a process cartridge to be detachably mounted to an image forming apparatus body capable of selecting an image forming condition. The process cartridge includes a cartridge frame, an electrophotographic photosensitive member, a processing device operative on the electrophotographic photosensitive member and a grip member. This grip member is disposed on the cartridge frame and is capable of being gripped to select an image forming condition when the process cartridge is mounted to the image forming apparatus body.

30 Claims, 18 Drawing Sheets

FIG.8(a)

DEVELOPMENT BIAS

| AC COMPONENT | AMPLITUDE | FREQUENCY |
|---|---|---|
| BLACK TONOR | 1200Vpp ± 10% | 2200Hz |
| COLOR TONOR | 1200Vpp ± 10% | 2200Hz |

| DC COMPONENT F-NUMBER | F9 | F6.5 | F5 | F3.5 | F1 |
|---|---|---|---|---|---|
| BLACK TONOR | −130V | −210V | −270V | −330V | −500V |
| COLOR TONOR | −165V | −265V | −325V | −385V | −530V |

PROCESS CARTRIDGE AND IMAGE FORMING APPARATUS

BACKGROUND OF THE INVENTION

1. Field of the Invention

This invention relates to a process cartridge and to an image forming apparatus detachably mounted with the process cartridge. The process cartridge is a unit into which charging means, developing means, or cleaning means, and an electrophotographic photosensitive member are incorporated and is detachably attached to the body of an image forming apparatus; the process cartridge is also a unit into which at least one of charging means, developing means, and cleaning means, and an electrophotographic photosensitive member are incorporated and is detachably mounted to the body of an image forming apparatus; the process cartridge is further a unit into which at least developing means and an electrophotographic photosensitive member are incorporated and is detachably mounted to an apparatus's body.

The image forming apparatus in this specification includes, for example, a laser beam printer, a photocopier, a facsimile machine, a word processor, and the like.

2. Description of Related Art

Image forming apparatuses using an electrophotographic image forming process have conventionally used a process cartridge method in which an electrophotographic photosensitive member and process means operating on the electrophotographic photosensitive member are incorporated into a cartridge, which is detachably mounted to an image forming apparatus body. According to such a process cartridge method, users could maintain their apparatuses by themselves without relying on service persons, so that the apparatuses could greatly improve the control thereof. Therefore, such a process cartridge method has been widely used in image forming apparatuses.

Meanwhile, with the process cartridge method, it has been known that the image forming condition can be controlled in association with the characteristics of the process cartridge. Such a technique is disclosed in, for example, U.S. Pat. No. 4,500,195. This conventional technique is very useful when process cartridges having different characteristics are mounted commonly to an image forming apparatus to form images.

SUMMARY OF THE INVENTION

It is an object of the invention to provide a process cartridge and an image forming apparatus capable of producing high quality images, even where the process cartridges have different characteristics from one another.

It is another object of the invention to provide a process cartridge and an image forming apparatus capable of producing high quality images, even where the respective process cartridges contain toners of different types.

It is yet another object of the invention to provide a process cartridge and an image forming apparatus capable of selecting one of image forming conditions in association with a grip member.

It is a further object of the invention to provide a process cartridge and an image forming apparatus capable of selecting one of image forming conditions in association with a grip member with respect to black and color toner contained therein.

It is a yet another object of the invention to provide a process cartridge having a cartridge frame, an electrophotographic photosensitive member, process means for operating to the electrophotographic photosensitive member, and a grip member, arranged on the cartridge frame, capable of being gripped and selecting one of image forming conditions when the process cartridge is mounted to an image forming apparatus body and to provide an image forming apparatus capable of being mounted with the process cartridge.

DETAILED DESCRIPTION OF THE PREFERRED EMBODIMENTS

Figure 1:
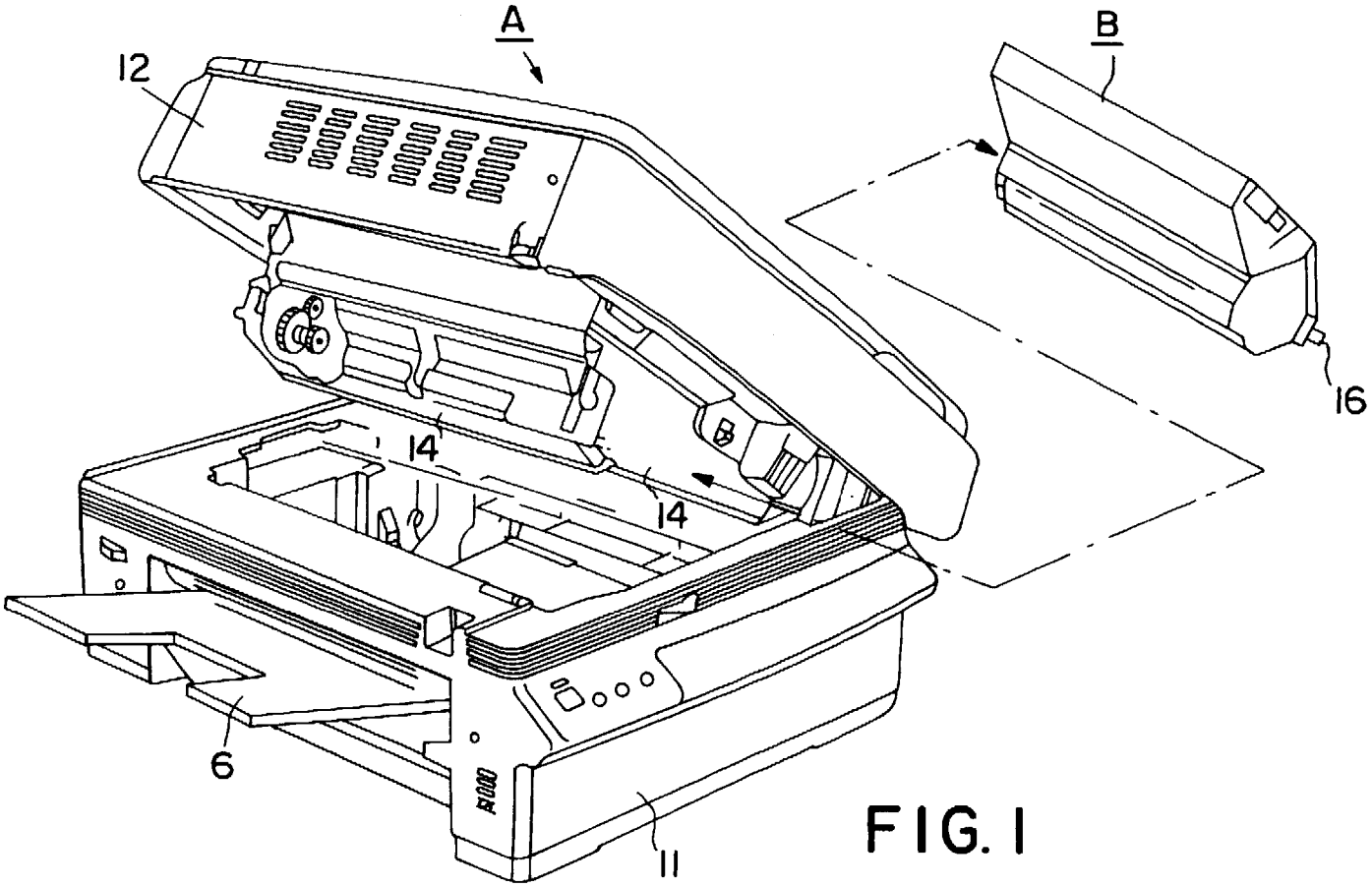
FIG. 1 is a perspective diagram showing an image forming apparatus, with an opened upper housing thereof, of the first embodiment according to the invention.

Referring to the drawings, a process cartridge and an image forming apparatus as an embodiment according to the invention will be described in detail.

[First Embodiment]

Figure 2:
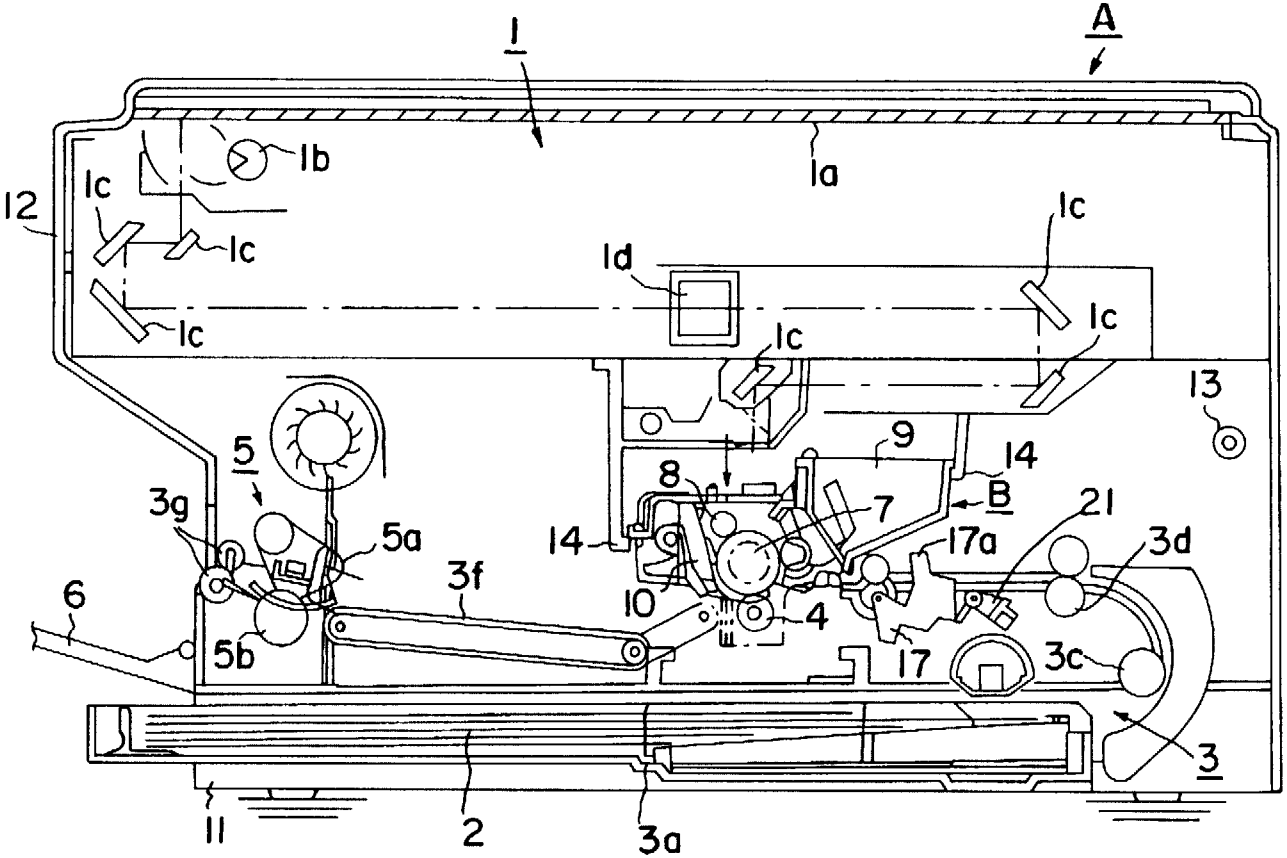
FIG. 2 is a structural illustration of the image forming apparatus.
Figure 3:
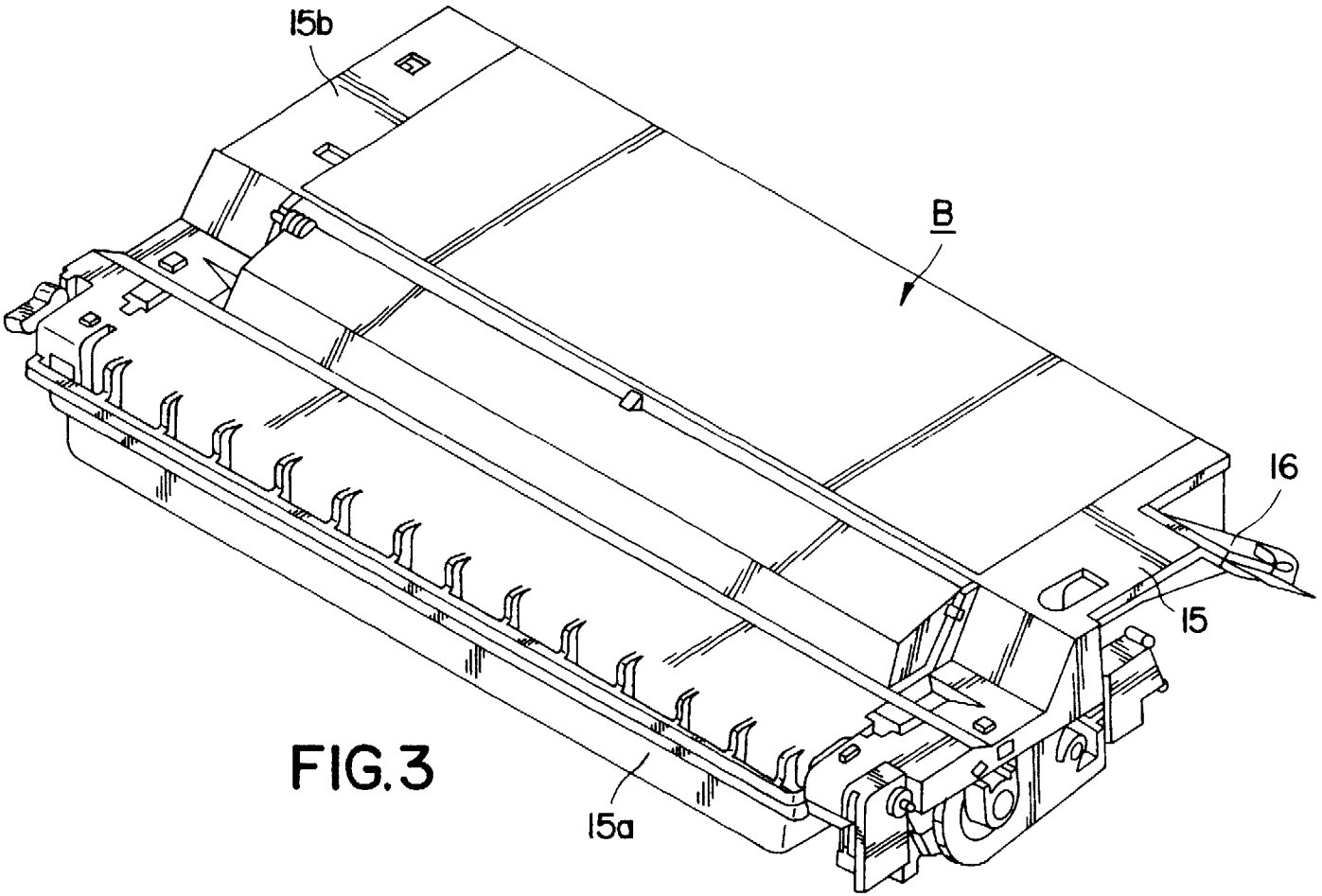
FIG. 3 is a perspective illustration showing a process cartridge.
Figure 4:
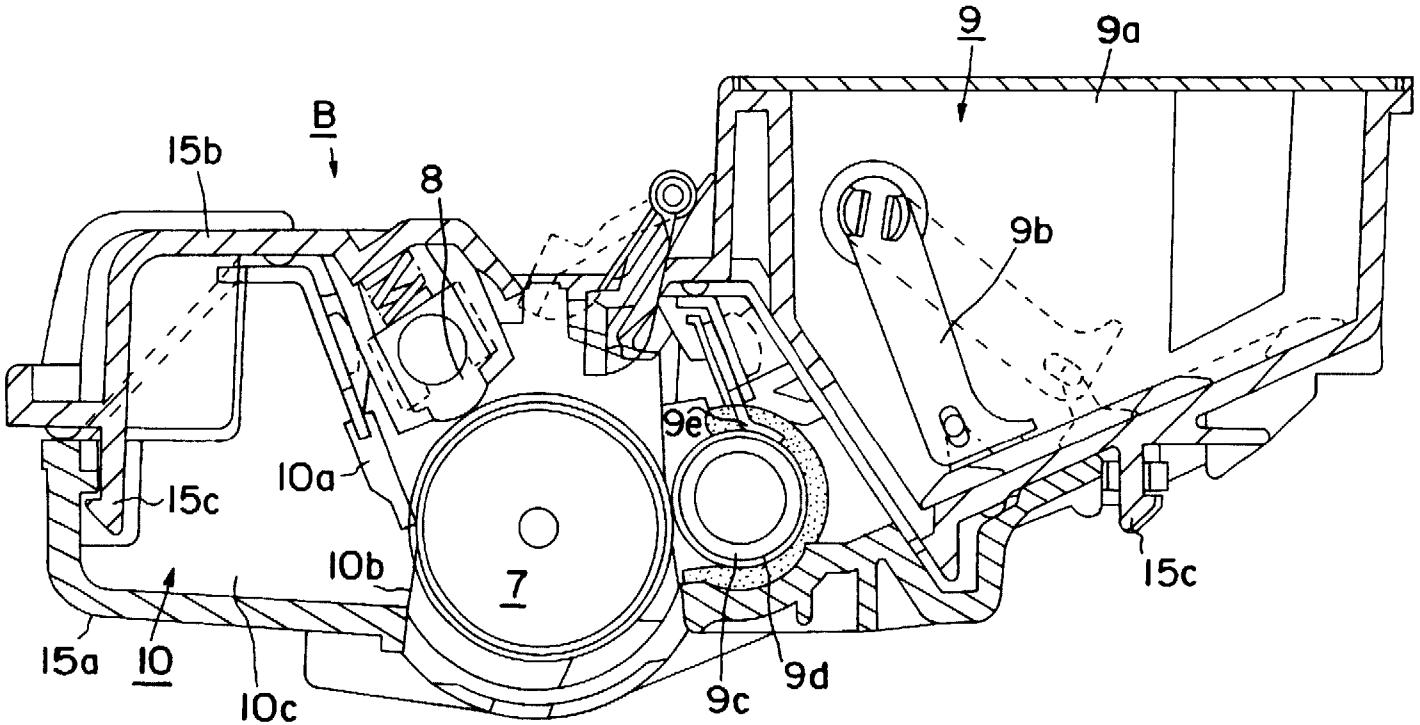
FIG. 4 is a structural illustration of the process cartridge.
Figure 5:
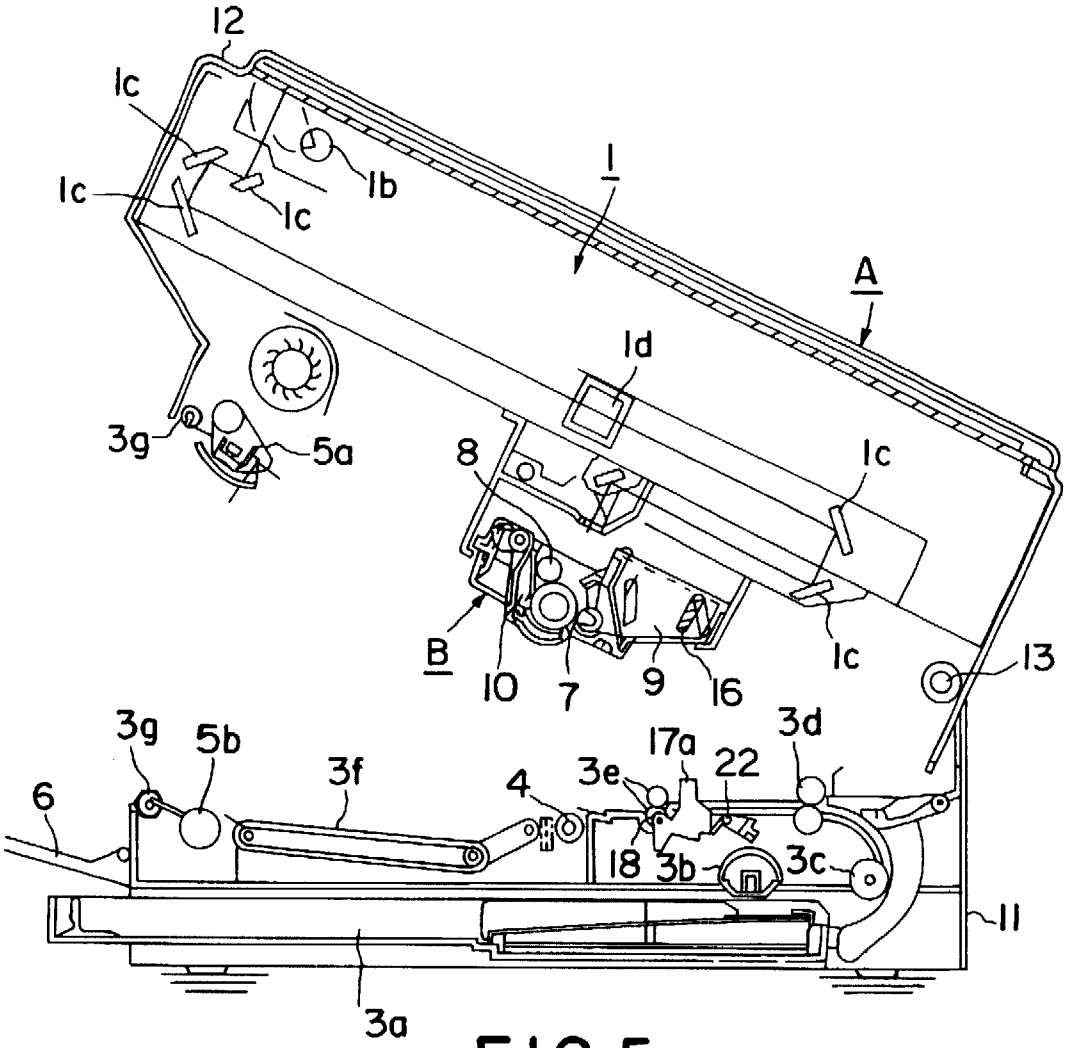
FIG. 5 is a structural illustration of the image forming apparatus with the opened upper housing thereof.

FIGS. 1 and 2 are structural illustrations of the image forming apparatus; FIGS. 3 and 4 are structural illustrations of the process cartridge; FIGS. 5 to 10 are structural illustrations of the grip member. As an order of the description below, first the entire constitution of the process cartridge and the image forming apparatus will be described with reference to FIGS. 1 to 4, and subsequently, a constitution for detection of the grip member will be described with reference to FIGS. 5 to 10.

[The Entire Constitution of the Apparatus and the Process Cartridge]

The image forming apparatus A is, as shown in FIGS. 1 and 2, to form a latent image on a photosensitive drum as an image carrier by projecting a photo-image based on image information from a reading means 1 and to transfer the latent image onto a recording medium 2 by converting it to a toner image with developing means. The image forming apparatus A described below is an electrophotographic image forming apparatus for producing images using an electrophotographic image forming method.

The reading means 1 projects light from a light source 1*b* located in opposition to the original document placed on a glass 1*a* so as to face the glass with the image side thereof, produces a latent image by projecting the reflecting light onto the photosensitive drum placed within the process cartridge B through plural mirrors 1*c* and lens 1*d*, attaches toner onto the latent image by the developing means, and produces the toner image.

Meanwhile, synchronously with production of the images, a recording medium 2 is conveyed by conveying means 3 constituted of a feeding cassette 3*a*, a pickup roller 3*b*, a reverse roller 3*c*, a pair of conveyance rollers 3*d*, a pair of register rollers 3*e*, and the like. In the image forming portion utilizing a cartridge as of the process cartridge B, the toner image formed on the photosensitive drum is transferred onto the recording medium 2 using the transfer roller 4 as transferring means, and the recording medium 2 is then conveyed to fixing means 5 by a conveyance belt 3*f*.

The fixing means 5 is constituted of a fixing rotary body 5*a* having a heater and a drive roller 5*b* to convey the recording medium 2 to the rotary body 5*a* with pressure thereon, to fix the toner image by application of heat and pressure when the recording medium 2 passes in the space between the rotary body 5*a* and the roller 5*b*. The recording medium 2 passed through the fixing means 5 is delivered to a delivery tray 6 by a pair of delivery rollers 3*g*.

An image forming process regarding the process cartridge B constituting the image forming portion is described again. As shown in FIGS. 3 and 4, the photosensitive drum 7 as an image carrier or an electrophotographic photosensitive member having a photosensitive layer is rotated to evenly charge its surface by voltage application from the charging roller 8 as charging means. The light image from the reading means 1 is exposed onto the photosensitive drum 7 through an opening for exposure to form a latent image, which is developed by the developing means 9. The developing means 9 feeds toner in a toner reservoir 9*a* by the toner feeding member 9*b*, rotates the developing roller 9*d* incorporating a fixed magnet 9*c*, and produces on the surface of the developing roller 9*d* a toner layer with triboelectric charges applied from a developing blade 9*e*. The toner is then transferred onto the photosensitive drum 7 according to the latent image to form a toner image and to visualize it.

After the toner is transferred onto the recording medium 2 by application of a voltage having the opposite polarity to the toner image to the transfer roller 4, the remaining toner on the photosensitive drum 7 is scraped off by a cleaning blade 10*a* and is collected by a collecting sheet 10*b*, and thereby, cleaning means 10 for collecting the toner into a used toner reservoir 10*c* removes the remaining toner on the photosensitive drum 7.

Figure 12:
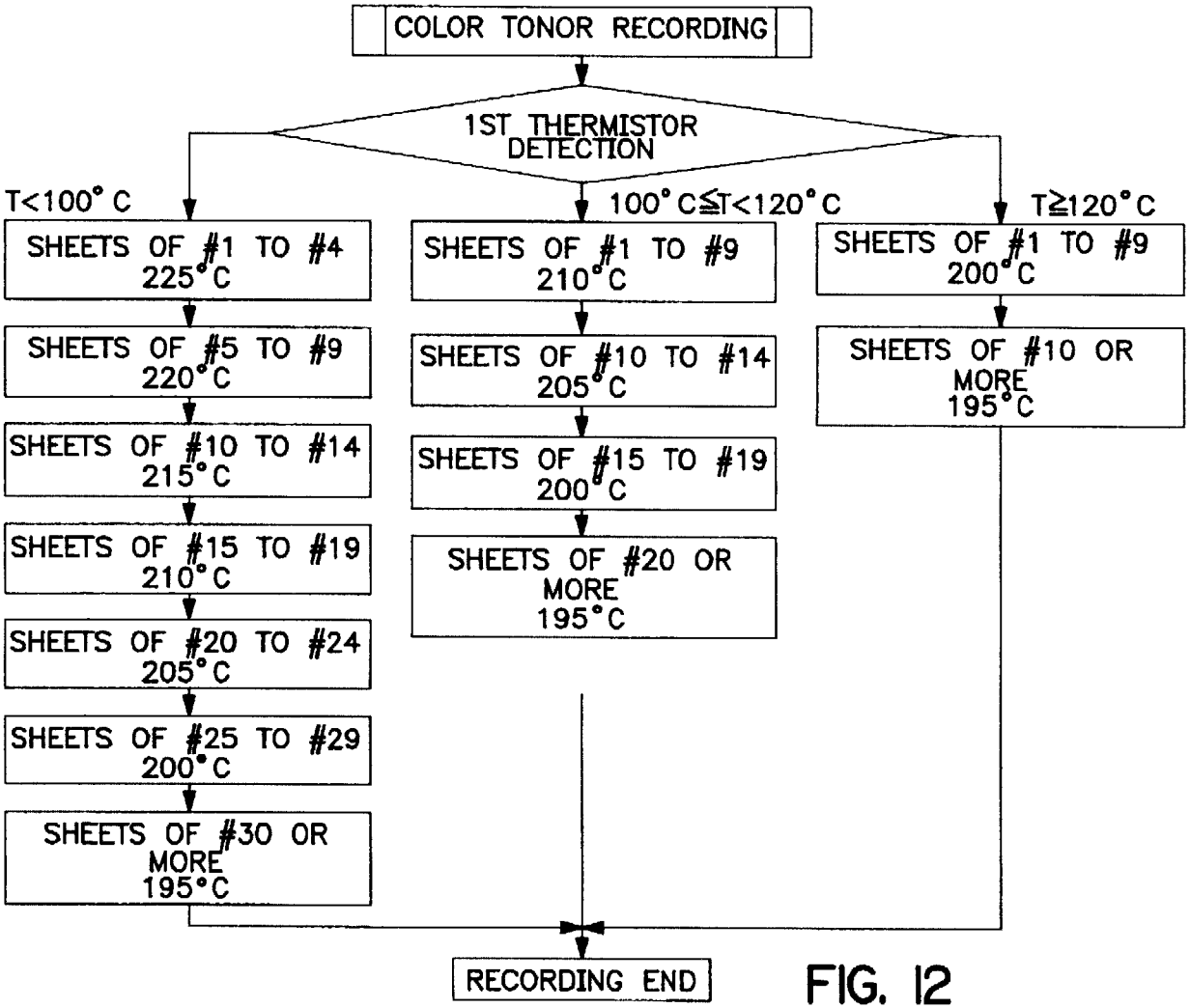
FIG. 12 is a flow chart of a sub-routine for fixing temperature for the color toner.

The image forming apparatus A constitutes an apparatus body by a lower housing 11 and an upper housing 12 as shown in FIG. 12; the upper housing 12 is rotatable around a shaft 13 (see FIG. 2) and capable of opening and closing against the lower housing with respect to the shaft 13 serving as a hinge. Mounting means for being mounted with the process cartridge B is arranged on the upper housing 12. The mounting means is provided, as shown in FIGS. 1 and 2, with attachment guides 14 for supporting both sides in a crosswise direction of the process cartridge B, placed with a certain interval therebetween, and makes the process cartridge B mounted and detached by insertion and removal of the process cartridge B along the guides 14.

[Constitution for Detection of the Grip Member]

A constitution for detection of the grip member 16 arranged on the process cartridge B is described as follows.

The process cartridge B in this embodiment is as shown in FIG. 4 formed in a cartridge by containing process means such as photosensitive drum 7 and the developing means 9 in a cartridge frame 15, which is constituted of a lower frame 15*a* and an upper frame 15*b*, connected by a connecting tongue 15*c*; a grip member 16 is formed at one side of the frame and unitedly with the frame 15 so as to make handling of the frame 15 easier.

Figure 6A:
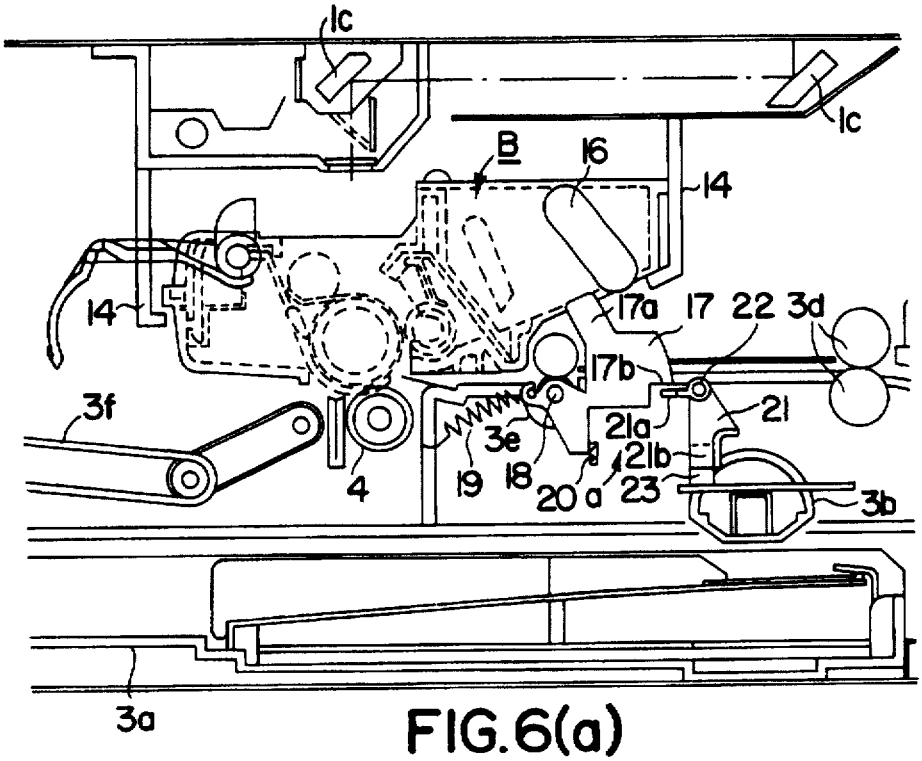
FIGS. 6(A) and 6(*b*) are illustrative diagrams showing operations of detecting means where a black cartridge is mounted (a) and where a color cartridge is mounted (b)
Figure 6B:
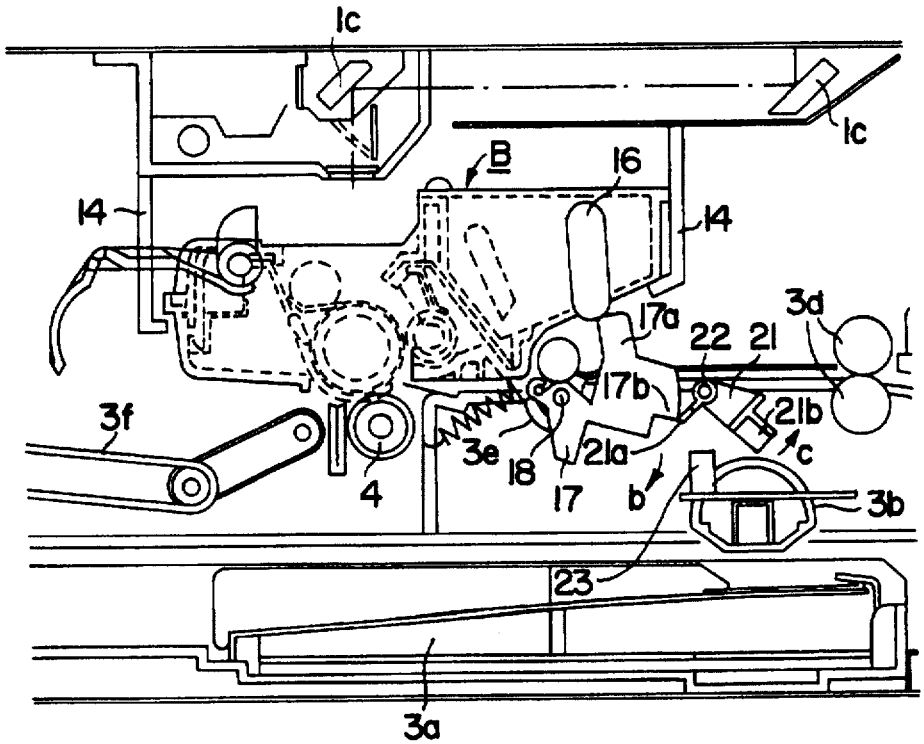
Figure 7B:
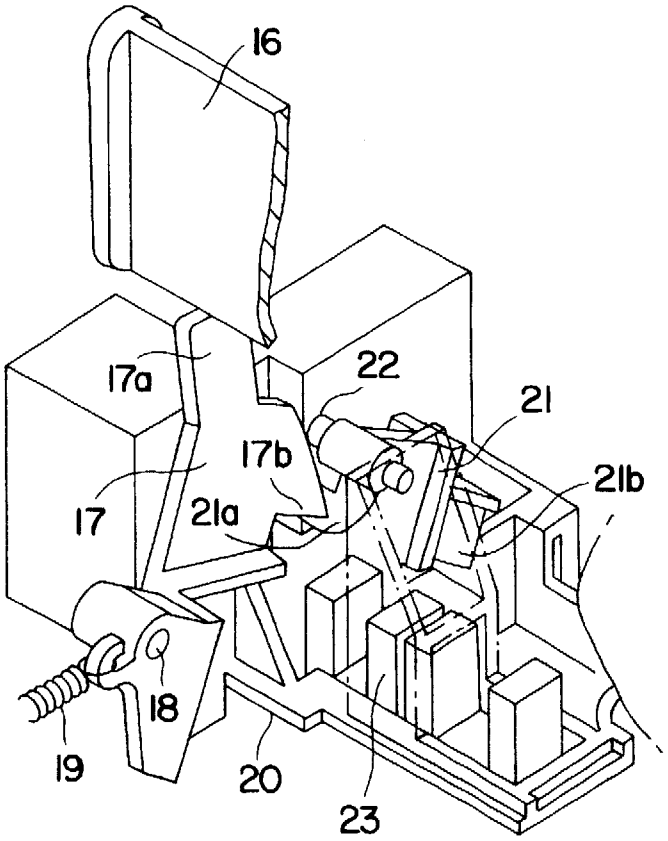
FIGS. 7(A) and 7(*b*) are perspective diagrams showing the structure of the detecting means.
Figure 7A:
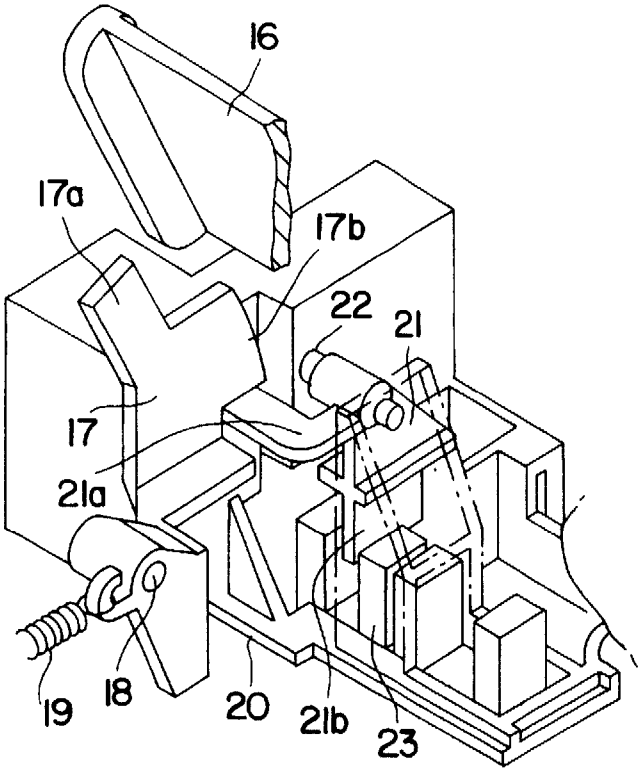

The grip member 16 is attached differently depending on whether a process cartridge containing black toner (hereinafter referred to as a "black cartridge") is used and whether a process cartridge containing color toner such as blue or red (hereinafter referred to as a "color cartridge") is used. The attachment state of the grip member may include, for example, angles attaching the grip member, positions at which the grip member is attached, or the like, and in this embodiment, a structure in which the grip member 16 is attached with different angles with respect to the type of the process cartridge is described.

Where the black cartridge is used, as shown in FIG. 6(*a*), the attachment angle of the grip member 16 is inclined so to be inclined downward on a right side thereof where the member is attached to the frame 15. On the other hand, where the color cartridge is used, as shown in FIG. 6(*b*), the grip member 16 becomes upright (in a vertical direction) where the member is attached to the frame 15.

The image forming apparatus A can use any of the black cartridge and the color cartridge, distinguish as to whether the process cartridge mounted is the black cartridge or the color cartridge, and change the image forming condition in association with the mounted cartridge.

To do so, the image forming apparatus A has cartridge detecting means for detecting the kind of the process cartridge B. The kind of the cartridge is detected by detecting the attaching state of the grip member 16. As shown in FIGS. 6(A), 6(*b*), 7(A) and 7(*b*), the detecting means is constituted of an identification lever 17 attached to the lower housing 11 so as to be rotatable around a shaft 18 of the register roller 3*e*. The identification lever 17 is pulled by a pulling spring 19 toward the direction of arrow a in FIG. 6(*a*) and is normally in contact with a stopper 20. The identification lever 17 has a contacting portion 17*a* at an upper side thereof and is formed with an engagement portion 17*b* on the right end thereof.

A supplemental lever 21 is attached to a position to engage with the engagement portion 17*b* so as to be rotatable around a shaft 22. The supplemental lever 21 has an engagement indentation 21*a* capable of engaging with the engagement portion 17*b* of the rotating identification lever 17 and a shield portion 21*b* for cutting the light incident to a photosensor 23.

The supplemental lever 21, when not in contact with the identification lever 17, as shown in FIG. 6(*a*), cuts the light to the sensor 23 by allowing the shielding portion 21*b* to hang down according to its weight and thereby to contact to the sensor 23. On the other hand, as shown in FIG. 6(*b*), when the identification lever 17 rotates toward the direction of arrow b in opposition to an elastic force of the spring 19, the engagement portion 17*b* pulls down the engagement indentation 21*a* of the supplemental lever 21, thereby rotating the supplemental lever 21 in the direction of arrow c. The shield portion 21*b* thus comes to be out of the light path to the photosensor 23.

When the black cartridge having the inclined grip member 16 is attached, the grip member 16 does not interfere with the identification lever 17 as shown in FIG. 6(*a*). Therefore, the identification lever 17 and the supplemental lever 17 do not interfere with each other, so that the shield portion 21*b* of the supplemental lever 21 cuts the light path to the sensor 23, thereby turning off the sensor 23. In contrast, when the color cartridge having the upright grip member 16 is attached, the grip member 16 does pull down the contacting portion 17*a* of the identification lever 17 as shown in FIG. 6(*b*). Therefore, as described above, the identification lever 17 is made to rotate in the direction of arrow b, and the supplemental lever 21 is made to rotate in the direction of arrow c, so that the shield portion 21*b* comes out of the light path to the sensor 23 and so that the sensor 23 is turned on. Accordingly, whether the mounted process cartridge is either the black cartridge or the color cartridge can be detected by the tuning on and off of the sensor 23.

The image forming apparatus A, after detecting the cartridge, controls changing of the image forming condition in accordance with whether the black cartridge is mounted or whether the color cartridge is mounted. In this embodiment, the image forming apparatus A is designed to change DC voltage for development bias and fixing temperature.

Figure 8B:
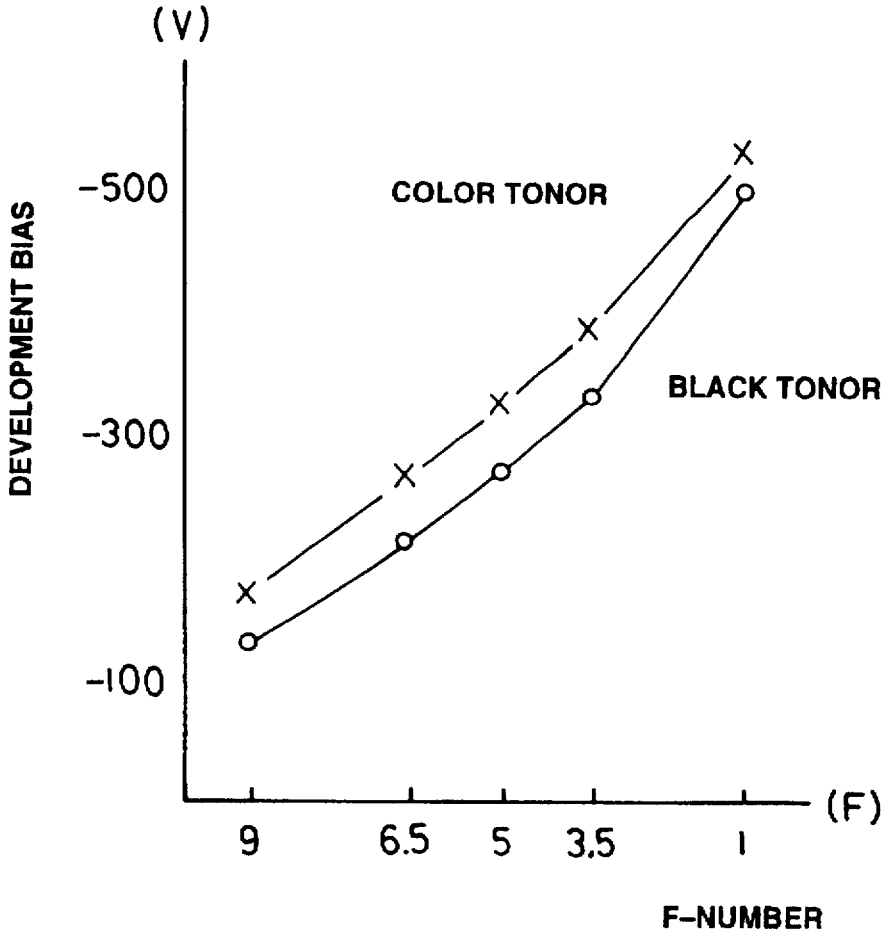
FIGS. 8(A) and 8(*b*) are diagrams showing development bias voltage with respect to the black toner and to the color toner in relation with f-number.

That is, in this embodiment, the development bias is the same, as shown in FIG. 8(*a*), between when the black toner is used and when the color toner is used, with respect to the AC component, but is higher when the color toner is used than when the black toner is used, as shown in FIG. 8(*b*), with respect to the DC component versus f-number of an iris. Furthermore, a proper temperature for fixing images transferred is about five degree Celsius higher when the color toner is used than when the black toner is used.

Accordingly, upon a detection of the difference between the black cartridge and the color cartridge, the controlling means changes the development bias thereby making the image density proper, to compensate for the difference of the electrical charging characteristics according to the different toners. The controlling means also controls the temperature of the fixing heater to a target temperature to compensate for the difference of the thermal characteristics between the toners.

Figure 9:
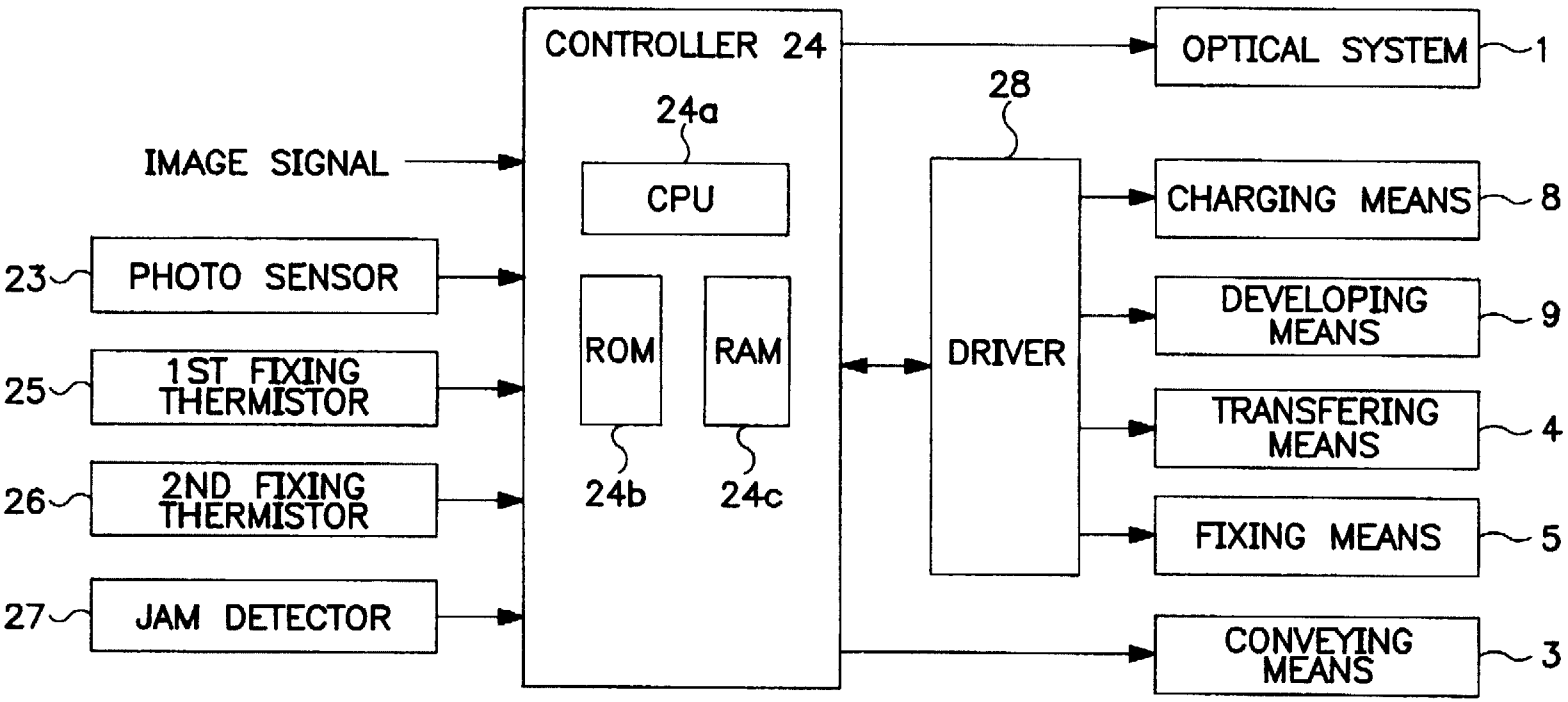
FIG. 9 is a block diagram showing a controlling system of the image forming apparatus.

As shown in FIG. 9, the controller 24 comprises a CPU 24*a* made of such as a microprocessor, a ROM 24*b* for storing control programs for the CPU 24*a* and various data, a RAM 24*a* used for a work area for the CPU 24*a* and for temporary retention of the various data, and the like, and controls various operations of the apparatus. The controller 24 receives a cartridge detection signal from the photosensor 23 as described above, temperature signals from a first thermistor for detecting the temperature of the fixing means 5 and from a second thermistor for detecting excessive temperature of the fixing means, a detecting signal from a jam detection sensor 27, and the like. The controller 24 feeds an emission signal for the optical system (reading means) 1, various bias voltage signals for the charging means 8, the developing means 9, and the transferring means 4 through a driver 28, and a temperature signal to the heater of the fixing means 5. The controller 24 also feeds a drive signal to various motors for driving the conveying means 3.

Figure 10:
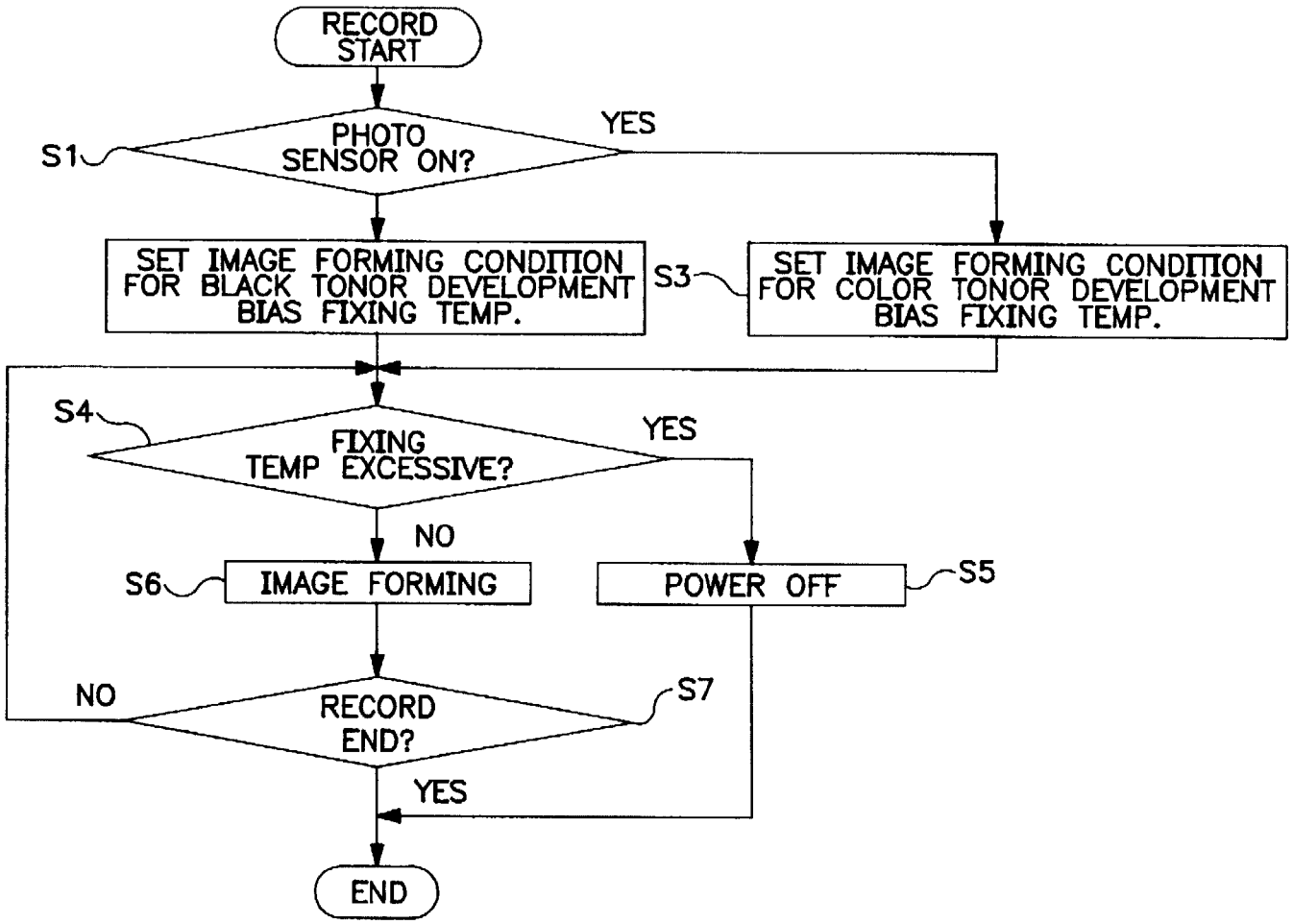
FIG. 10 is a flow chart showing steps for image forming in association with kinds of the process cartridge.

The procedure for when the controlling means changes the image forming condition in association with the kinds of the mounted cartridge, is described as follows, and is depicted in FIG. 10. First, it is detected as to whether the photosensor 23 is turned on or off, upon input of a recording start signal (S1). When the sensor 23 is turned off, the operation goes to step S2 and changes the image forming condition for the black toner, since the mounted cartridge is the black cartridge. On the other hand, when the sensor 23 is turned on, the operation goes to step S3 and changes the image forming condition for the color toner, since the mounted cartridge is the color cartridge. The image forming condition is composed, within the controller 24, of a black toner mode suitable for the black toner and of a color toner mode suitable for the color toner, in terms of the development bias DC value and fixing temperature. When the black cartridge is mounted, the condition is changed to the black toner mode; when the color cartridge is mounted, the condition is changed to the color toner mode. The DC component voltage of the development bias and fixing temperature are set to values higher when the color cartridge is mounted than values when the black cartridge is mounted.

Subsequently, it is judged as to whether the temperature of the fixing means 5 is equal to or less than the permissible temperature or not (S4). This temperature is detected by the second fixing thermistor 26, and if the temperature of the fixing means 5 is excessive, the power is turned off to end the operation (S5). On the other hand, if the temperature of the fixing means 5 is equal to or less than the permissible temperature, the image forming operation described above is performed (S6).

Figure 11:
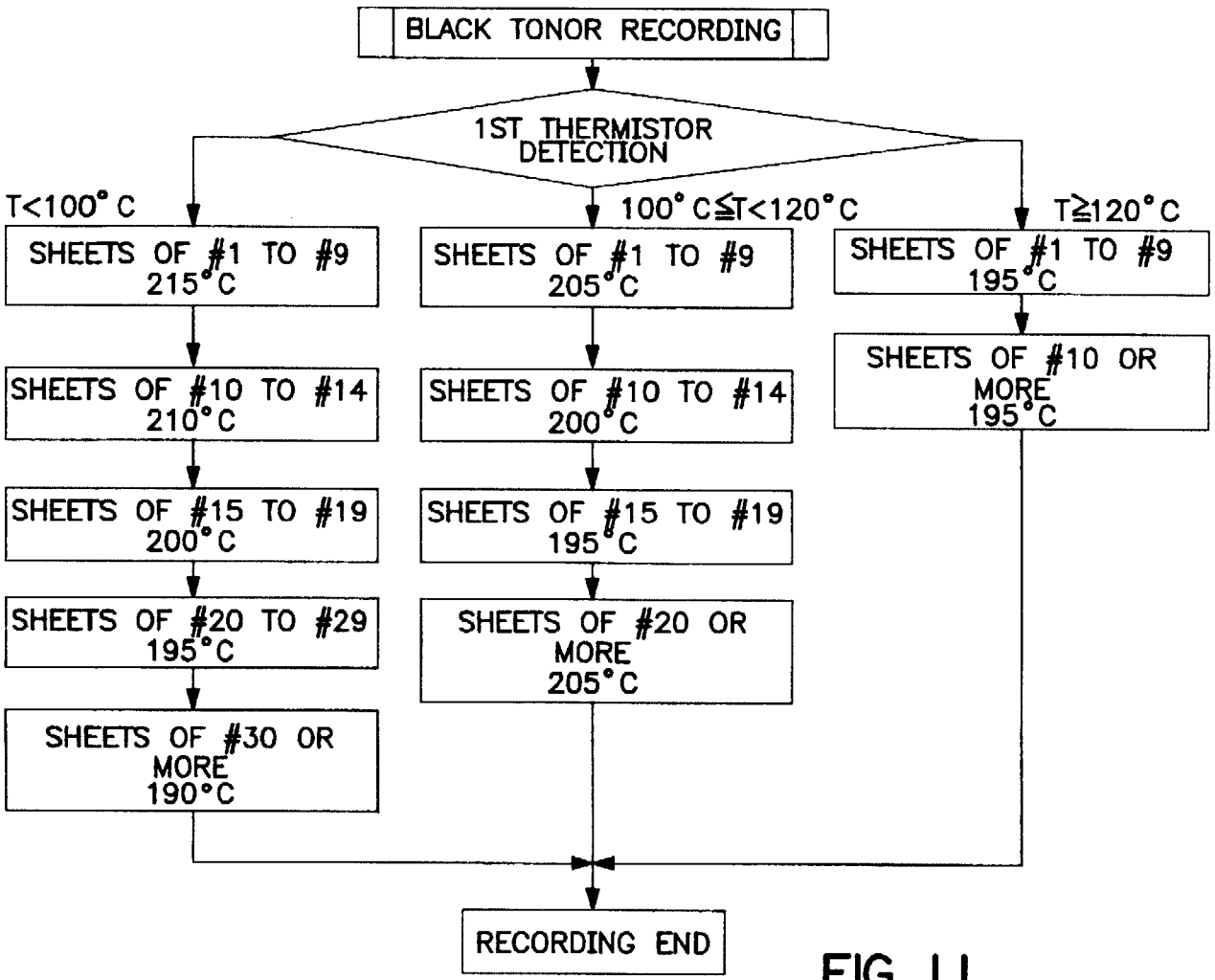
FIG. 11 is a flow chart of a sub-routine for fixing temperature for the black toner.

With this image forming operation, when the black toner is used, the development bias is set to the value for the black toner shown in FIGS. 8(A) and 8(*b*), and the fixing temperature is properly controlled as shown in FIG. 11 according to the temperature T of the inside of the apparatus, and the number of sheets for copying; when the color toner is used, the development bias is set to the value for the color toner shown in FIGS. 8(A) and 8(*b*), and the fixing temperature is properly controlled as shown in FIG. 12 according to the temperature T of the inside of the apparatus, and the number of sheets for copying. This operation repeats by the end of recording (S7).

It is to be noted that the development bias value and fixing temperature are not limited to the values above and can be properly set according to the kinds of the toners.

Thus, the image forming condition is to be changed between when the black cartridge is mounted and when the color cartridge is mounted, and the distinction is determined upon a detection of the attachment state of the grip member 16 of the mounted process cartridge by the photosensor 23.

The process cartridge described above is a process cartridge detachably mounted to the image forming apparatus body, capable of switching the image forming means, and has an electrophotographic photosensitive member, process means for operating on the electrophotographic photosensitive member, a cartridge frame, a developer container for containing developer to be used for developing latent images formed on the electrophotographic photosensitive member, and a grip member placed at a prescribed position on the cartridge frame so as to change an attachment state thereof in order to enable means arranged on the image forming apparatus body to select an image forming condition of the image forming apparatus body in association with the characteristics of the developer.

The image forming apparatus described above is capable of detachably mounting the process cartridge having the grip member. The image forming apparatus for forming images on recording media includes mounting means for mounting the process cartridge, detecting means for detecting the state of the grip member when the process cartridge is mounted to the mounting means, controlling means for selecting and controlling an image forming condition corresponding to the characteristics of the developer based on a signal from the cartridge detecting means.

Thus, to detect the kind of the process cartridge, nothing is needed except a change of the attachment angle of the grip member formed on the process cartridge, and it is unnecessary to provide projections or grooves for identification of kinds of process cartridges as in conventional devices, so that the outline of the apparatus becomes simpler and so that the users can readily carry the process cartridge without discomfort.

[Second Embodiment]

Although in the first embodiment described above the process cartridge having the grip member 16 attached with different angles from the beginning (between the black cartridge and the color cartridge) is exemplified, a process cartridge as the second embodiment capable of changing the attachment state of the grip member at a time of the assembly thereof will be described with reference to FIGS. 13 to 15(A) and 15(*b*). This process cartridge has the same constitution as the process cartridge in the first embodiment except the constitution of the grip member. The same elements are respectively given the same reference numbers, and their descriptions are invoked, as is also the case with the third and fourth embodiments.

Figure 13:
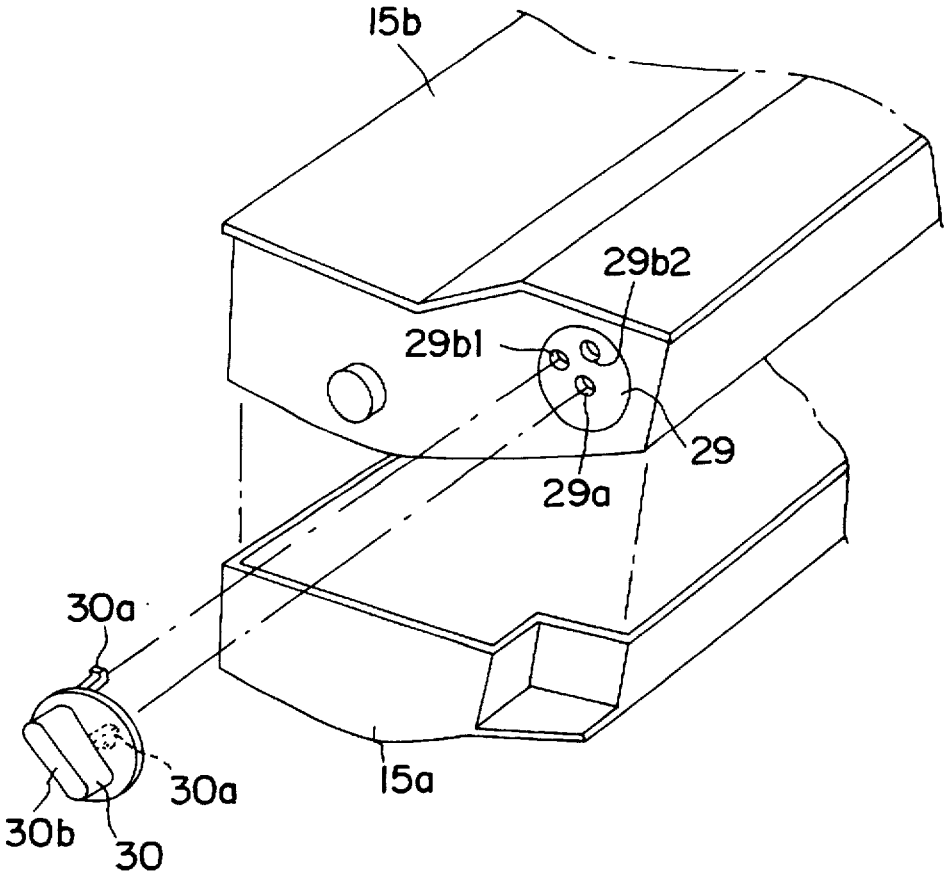
FIGS. 13 to 15(A) and 15(*b*) are illustrations showing respective embodiments in which a grip member is detachably attached.
Figure 14:
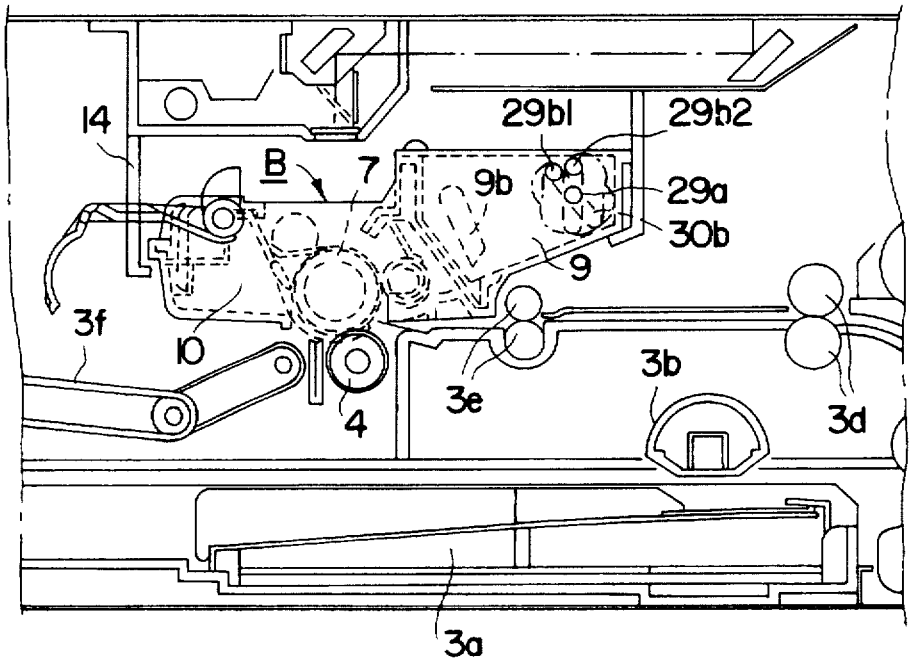

The process cartridge B according to this embodiment is, as shown in FIG. 13, formed with a grip attachment portion 29 on the upper frame 15*b*; the attachment portion 29 is formed with three engagement holes 29*a*, 29*b*1, 29*b*2. A grip member 30 is detachably attached to the grip attachment portion 29 and is formed with two tongues 30*a*. The two tongues 30*a* are capable of engaging with the engagement hole 29*a* and either of the engagement holes 29*b*1, 29*b*2 of the grip engagement portion 29; if the two tongues 30*a* are engaged with the engagement holes 29*a*, 29*b*1, a grip portion 30*b* is attached with an inclined attachment angle; if the two tongues 30*a* are engaged with the engagement holes 29*a*, 29*b*2, the grip portion 30*b* is attached upright with no inclined angle thereof.

It is to be noted that the grip member 30 is a so called "snap fitting structure" that is secured by pushing the tongues 30*a* into the engagement holes 29*a*, 29*b*1, 29*b*2 when assembled, and is detachable by disengaging the tongues 30*a* from the inside of the upper frame 15*b*, after the upper and lower frames 15*a*, 15*b* are separated.

Accordingly, the apparatus can record with the changed image forming condition, upon a detection of the attachment angle of the grip member 30 when the grip member 30 is attached to the image forming apparatus A, by attaching the grip member with changes of the attachment angle as between the black cartridge and the color cartridge.

Figure 15A:
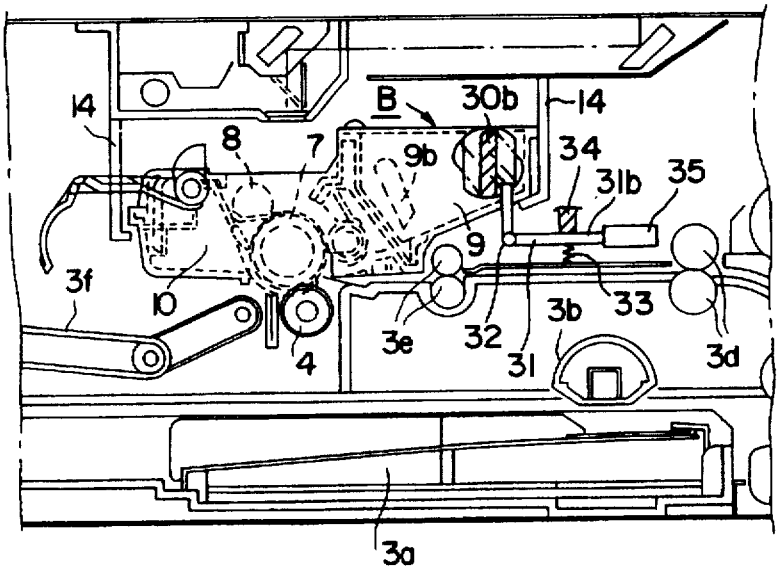
Figure 15B:
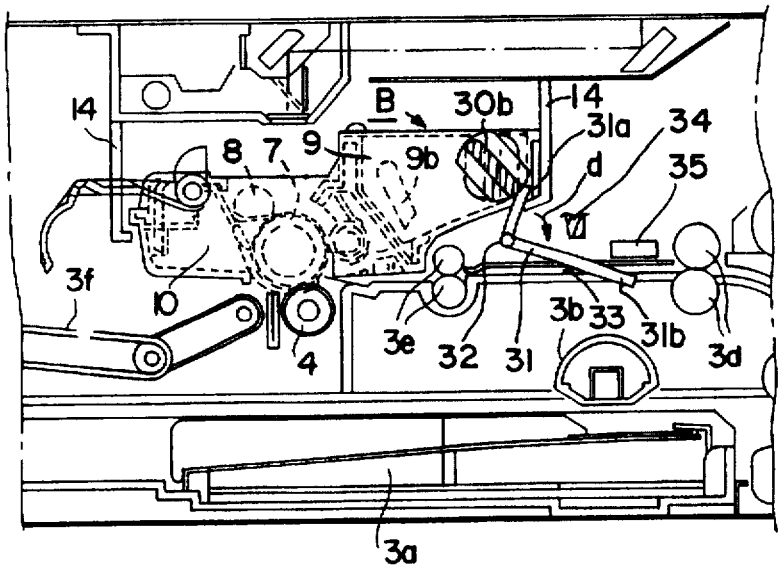

For example, when the constitution as shown in FIGS. 15(A) and 15(*b*) used as cartridge detection means, the images are recorded under the image forming condition in association with the particular kind of the cartridge through control in a manner as in the first embodiment, by attaching the grip portion 30*b* with no inclination in the case of the black cartridge and with inclination in the case of the color cartridge.

Notedly, the cartridge detecting means in this embodiment is constituted so that the identification lever 31 curving and having the contacting portion 31*a* and the shield portion 31*b* is attached so as to rotate around the shaft 32 and so that the identification lever 31 is urged in the counterclockwise direction by the pushing spring 33 and normally contacts the stopper 34. With this state, the shield portion 31*b* cuts the light path to the photosensor 35, and when the identification lever 31 is rotated, the shield portion 31*b* comes out of the light path to the photosensor 35.

With the black cartridge whose grip portion 30*b* is upright and not inclined, the grip portion 30*b* does not interfere the identification lever 31 even if the cartridge B is mounted and if the upper housing 12 is closed. As shown in FIG. 15(*a*), the shield portion 31*b* of the identification lever 31 cuts the light path to the photosensor 35 thereby turning off the photosensor 35.

On the other hand, with the color cartridge whose grip portion is inclined, the grip portion 30*b* pushes the contacting portion 31*a* of the identification lever 31 when the cartridge B is mounted and when the upper housing 12 is closed. As shown in FIG. 15(*b*), the identification lever 31 rotates around the shaft 32 in the direction of arrow d. The shield portion consequently comes out of the light path to the photosensor 35, so that the photosensor 35 is turned on.

Therefore, with the controlling means having the same constitution as the first embodiment described above, it is possible to detect the difference between the black cartridge and the color cartridge by the attachment state of the grip member 30, and it is possible to record images with changes of the image forming condition in association with the kind of the cartridge that is mounted.

With the process cartridge B according to this embodiment, the distinction of the black cartridge or the color cartridge can be set when the grip member 30 is assembled, so that when used cartridges are collected and reused, the kinds of the recycled cartridges can be set notwithstanding the kinds of the collected cartridges. Since the kind of the cartridges is changeable by only change of the attachment state of the grip member 30, it is possible not only to reduce the assembly steps when the cartridges are to be reused but also to reduce the number of mistakes during assembling.

Although in this embodiment the tongues and the engagement holes are formed at the grip member 30 and the frame 15, respectively, the engagement holes can be formed at the grip member 30, and the tongues can be formed at the frame 15. In addition to the grip member 30 being attached and detached by so called snap-fit fixture, the grip member 30 can be attached and detached by other constitutions such as screws or the like. The grip member 30 can be attached to the lower frame 15*a*.

[Third Embodiment]

Although in the first and second embodiment changes of the angle of the grip member as the attachment state are exemplified, the same effects can be obtained by changing the attachment position of the grip member.

Figure 16A:
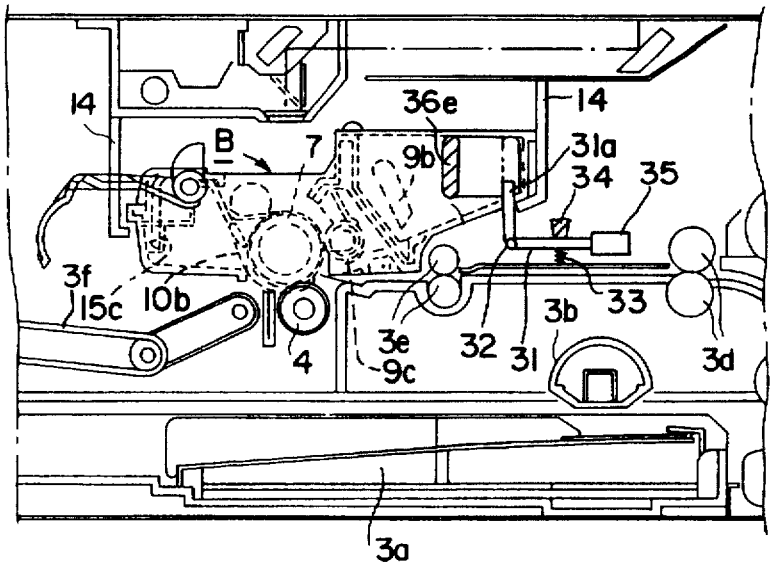
FIG. 16 is an illustration showing an embodiment in which a grip member is attached to different positions in association with the kinds of the process cartridge.

In the embodiment shown in FIGS. 16(A) and 16(*b*), the grip member 36 can be attached at a front position e or a rear position f of the cartridge frame 15, and the position of the grip member 36 is subject to change based on whether the black cartridge is used or the color cartridge is used.

When the grip member 36 is attached at the front position e, the grip member 36 does not interfere the identification lever 31, even if the process cartridge B is mounted and the upper housing 12 is closed. As shown in FIG. 16(*a*), the photosensor 35 remains turned off. On the other hand, when the grip member 36 is attached at the rear position f, the grip member 36 pushes the identification lever 31 when the process cartridge B is mounted and the upper housing 12 is closed. As shown in FIG. 16(*b*), the identification lever 31 rotates around the shaft 32, thereby turning on the photosensor 35. Notedly, the grip member 36 can be detachably attached, as in the second embodiment, by using the tongues and engagement holes, and further by using screws or adhesive.

Accordingly, the grip member 36 is attached at different positions in accordance with the black cartridge or the color cartridge, so that the apparatus body can automatically detect the kind of the cartridge. Therefore, the same effect as the embodiments above can be obtained in this embodiment. This structure also effectively prevents a wrong cartridge from being mounted because it is easy for users to identify the difference of the position of the grip member 36 as described above.

[Fourth Embodiment]

Figure 17A:
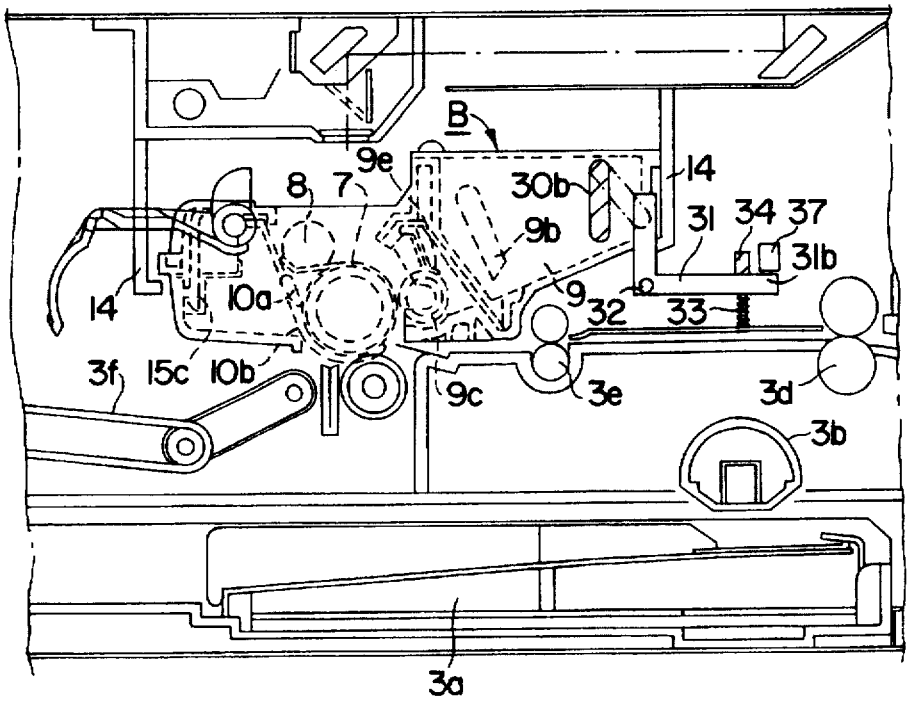
FIG. 17 is an illustration showing an embodiment using a micro-switch as a sensor.
Figure 17B:
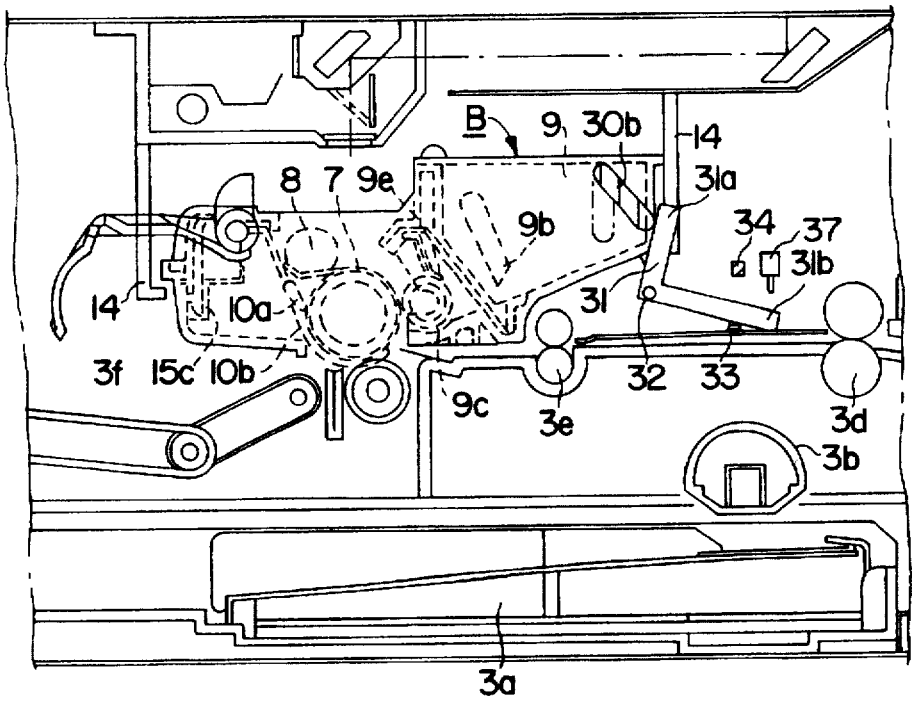

Although in the embodiments above, the use of photosensors as detecting means for the attachment state of the grip member is exemplified, the detecting means can be not only photosensors but also micro switches or the like. The same effects as the embodiments above can be obtained by, for example, as shown in FIGS. 17(A) and 17(*b*), placing micro switch 37 comprising a touch sensor in the pivotal range of the identification lever 31 described in the second embodiment, rendering the micro switch 37 turned off when the identification lever 31 rotates according to the attachment state of the grip member of the process cartridge B to be mounted, and rendering the switch turned on when the lever does not rotate.

[Other Embodiments]

Although in the embodiments above, the apparatus capable of detecting the differences between two kinds of the cartridges (black cartridge and color cartridge) is exemplified, it is possible to detect the differences among three or more kinds of the cartridges by increasing number of the detecting means. For example, it is possible for the apparatus to detect three kinds of cartridges by providing two identification levers and two identification sensors and changing operational patterns of the two sensors in accordance with the attachment state of the grip member. Furthermore, if the two sensors are provided, the apparatus can identify four patterns, so that when only three kinds of cartridges are to be detected, the remaining one pattern can be utilized to detect as to whether the process cartridge is mounted or not.

Although in the embodiments above, the apparatus in which the process cartridge B is mounted to the upper housing 12 and in which the sensor as the detecting means is formed on the lower housing 11 is exemplified, the same effects as the embodiments above can be obtained by mounting the process cartridge B to the lower housing 11 and forming the sensor as the detecting means on the upper housing 12.

As for respective means for constituting the process cartridge, specifically, as for the developing means, the known two component magnetic brush development method, the cascade development method, the touchdown development method, the cloud development method, and the like are usable.

As an image carrier, which is not restricted to the photosensitive drum described above, the following can be used. A photoconductor can be used for the photosensitive member and can include materials such as amorphous silicon, amorphous selenium, zinc oxide, titanium oxide, organic photo conductor (OPC) and the like. As the form for mounting the photosensitive member, for example, a rotary body such as a drum-shaped body, a belt-shaped body, and the like and a sheet-shaped body are used. In general, a drum or belt-shaped body has been used, and for example, a drum type photosensitive member is constituted of a cylinder made of aluminum alloy or the like, on which a photo conductor is evaporated or coated.

The charging means, though in the first embodiment the so called contact charging method is used, can be, as a matter of course, constituted by forming a metal shield such as aluminum at three-quarters of the surrounding sides of a tungsten wire, moving to the surface of the photosensitive drum positive or negative ions occurring upon an application of high voltage to the tungsten wire, and charging evenly the surface of the drum. Notedly, the charging means can be a blade type (a charging blade), a pad type, a block type, a rod type, a wire type and the like, in addition to the roller type.

The cleaning means, as means for cleaning toner remaining on the photosensitive drum, can be comprised of a blade, a fur brush, a magnetic brush, and the like.

The process cartridge described above is one that is formed with the electrophotographic photosensitive member and at least one process means. Therefore, as a possible constitution, in addition to the constitution in the embodiments above, for example, the apparatus can use a process cartridge in which: the electrophotographic photosensitive member and the charging means are made into a cartridge which is detachably mounted to the apparatus body; the electrophotographic photosensitive member and the developing means are made into a cartridge which is detachably mounted to the apparatus body; the electrophotographic photosensitive member and the cleaning means are made into a cartridge which is detachably mounted to the apparatus body; the electrophotographic photosensitive member and two or more of the process means are made into a cartridge which is detachably mounted to the apparatus body.

Although in the embodiments described above a laser beam printer is exemplified as the image forming apparatus, it is unnecessary to limit the invention to this, and the image forming apparatus can be as a matter of course, for example, an electrophotographic photocopier, a facsimile machine, a word processor, and the like.

According to the embodiments described above, when the process cartridge is mounted to the image forming apparatus body, the apparatus can detect the grip member and can select an image forming condition in association with the detected result, so that the apparatus can form images properly in accordance with the kinds of the cartridges mounted.

This invention can provide, using the grip member, a process cartridge and an image forming apparatus which are capable of selecting an image forming condition

What is claimed is:

1. A process cartridge detachably mountable to an image forming apparatus body capable of selecting an image forming condition, said process cartridge comprising:

a cartridge frame;

an electrophotographic photosensitive member;

process means for operating on said electrophotographic photosensitive member; and a grip member, which is capable of being gripped, disposed on said cartridge frame so as to select an image forming condition when said process cartridge is mounted to the image forming apparatus body.

wherein the grip member is disposed with an attachment angle that corresponds to a kind of toner contained in a toner container in order to select the image forming condition in association with the kind of the toner contained in the toner container, wherein said grip member is disposed to extend in a substantially vertical direction when said process cartridge is mounted to an image forming position of the image forming apparatus body in a case where the toner contained in the toner container is a color toner, and wherein the image forming apparatus body selects the image forming condition to increase a DC voltage for development bias to be applied to developing means as said process means, and to increase a fixing temperature of fixing means in comparison with a case where a process cartridge containing black toner is mounted.

2. The process cartridge according to claim 1, wherein said grip member is disposed with an inclination relative to a substantially vertical direction when said process cartridge is mounted to an image forming position of the image forming apparatus body in a case where the toner contained in the toner container is black.

3. The process cartridge according to claim 2, wherein said grip member is inclined downwardly on a right side thereof relative to the substantially vertical direction.

4. The process cartridge according to any one of claims 1, 2 or 3, wherein said process cartridge is mounted to the image forming apparatus body along an axial direction of said electrophotographic photosensitive member, and wherein said grip member is formed unitedly at a portion of said cartridge frame located at a trailing portion of said process cartridge relative to the mounting direction thereof.

5. The process cartridge according to claim 1, wherein, in accordance with an attachment angle of said grip member, the image forming apparatus body can detect that a process cartridge containing black toner has been mounted thereto, and, in such a case, the image forming apparatus body selects the image forming condition to reduce a DC voltage for development bias to be applied to developing means as said process means, and to reduce a fixing temperature of fixing means in comparison with a case when a process cartridge containing color toner is mounted.

6. The process cartridge according to claim 5, wherein, when said process cartridge is mounted to the image forming apparatus body at the image forming position, and said grip member is disposed with an inclination relative to the substantially vertical direction, said grip member does not contact a lever member disposed in the image forming apparatus body, and a sensor disposed in the image forming apparatus body is turned off, the image forming apparatus body thereby detecting that a process cartridge containing black toner is mounted to the image forming apparatus body.

7. The process cartridge according to claim 1, wherein, when said process cartridge is mounted to the image forming apparatus body at the image forming position, and said grip member is disposed so as to extend in the substantially vertical direction, said grip member contacts a lever member disposed in the image forming apparatus body, and a sensor disposed in the image forming apparatus body is turned on, the image forming apparatus body thereby detecting that a process cartridge containing color toner is mounted to the image forming apparatus body.

8. A process cartridge detachably mountable to an image forming apparatus body capable of selecting an image forming condition, said process cartridge comprising:

a cartridge frame;

an electrophotographic photosensitive member;

process means for operating on said electrophotographic photosensitive member; and a grip member, which is capable of being gripped, disposed on said cartridge frame so as to select an image forming condition when said process cartridge is mounted to the image forming apparatus body, wherein, in accordance with an attachment angle of said grip member, the image forming apparatus body can detect that a process cartridge containing color toner has been mounted thereto, and, in such a case, the image forming apparatus body selects the image forming condition to increase a DC voltage for development bias to be applied to developing means as said process means, and to increase a fixing temperature of fixing means in comparison with a case when a process cartridge containing black toner is mounted.

9. The process cartridge according to claim 8, wherein said grip member is placed at a position of said cartridge frame differently in accordance with a kind of toner contained in the toner container.

10. The process cartridge according to claim 8, wherein said grip member is detachably mounted to said cartridge frame.

11. The process cartridge according to claim 8, wherein said process cartridge is a unit into which at least one of charging means, developing means, and cleaning means as said process means, and said electrophotographic photosensitive member are incorporated, and which is detachably mounted to the image forming apparatus body.

12. The process cartridge according to claim 8, wherein said process cartridge is mounted to the image forming apparatus body along an axial direction of said electrophotographic photosensitive member, and wherein said grip member is formed unitedly at a portion of said cartridge frame located at a trailing portion of said process cartridge relative to the mounting direction thereof.

13. The process cartridge according to claim 8, wherein, in accordance with an attachment angle of said grip member, the image forming apparatus body can detect that a process cartridge containing black toner has been mounted thereto, and, in such a case, the image forming apparatus body selects the image forming condition to reduce a DC voltage for development bias to be applied to developing means as said process means, and to reduce a fixing temperature of fixing means in comparison with a case when a process cartridge containing color toner is mounted.

14. The process cartridge according to claim 13, wherein, when said process cartridge is mounted to the image forming apparatus body at an image forming position, and said grip member is disposed with an inclination relative to a substantially vertical direction, said grip member does not contact a lever member disposed in the image forming apparatus body, and a sensor disposed in the image forming apparatus body is turned off, the image forming apparatus body thereby detecting that a process cartridge containing black toner is mounted to the image forming apparatus body.

15. The process cartridge according to claim 8, wherein, when said process cartridge is mounted to the image forming apparatus body at an image forming position, and said grip member is disposed so as to extend in a substantially vertical direction, said grip member contacts a lever member disposed in the image forming apparatus body, and a sensor disposed in the image forming apparatus body is turned on, the image forming apparatus body thereby detecting that a process cartridge containing color toner is mounted to the image forming apparatus body.

16. An image forming apparatus for forming an image on a recording medium, and to which a process cartridge is detachably mountable, said image forming apparatus comprising:

a. mounting means for detachably mounting a process cartridge that is chosen from among a plurality of process cartridges respectively containing different types of toner, the process cartridge having a cartridge frame, an electrophotographic photosensitive drum, developing means for developing a latent image formed on the electrophotographic photosensitive drum, a toner container for containing toner used by the developing means to develop the latent image formed on the electrophotographic photosensitive drum, and a grip member disposed on the cartridge frame with an attachment angle corresponding to a type of the toner contained in the toner container, the attachment angle being used to select an image forming condition according to the type of toner contained in the toner container when the process cartridge is mounted to an image forming apparatus body of said image forming apparatus;

b. a sensor for detecting the attachment angle of the grip member of the process cartridge mounted to said mounting means;

c. controlling means for selecting the image forming condition in association with a detection result of said sensor, and for forming an image with the selected image forming condition;

d. fixing means for fixing onto the recording medium a toner image that is formed on the electrophotographic photosensitive drum of the process cartridge mounted to said mounting means and is transferred to the recording medium; and e. conveying means for conveying the recording medium.

17. The image forming apparatus according to claim 16, wherein, when the process cartridge is mounted to said mounting means at an image forming position, the grip member is disposed with an inclination relative to a substantially vertical direction in a case that the type of toner contained in the toner container of the process cartridge is black toner; and wherein, when the process cartridge is mounted to the image forming position, the grip member does not contact a lever member that is operative with said sensor, thereby rendering said sensor turned off, so that said sensor detects that a process cartridge containing black toner is mounted to said mounting means.

18. The image forming apparatus according to claim 16, wherein, when the process cartridge is mounted to said mounting means at an image forming position, the grip member is disposed so as to extend in a substantially vertical direction in a case that the type of toner contained in the toner container of the process cartridge is color toner; and wherein, when the process cartridge is mounted to the image forming position, the grip member contacts a lever member that is operative with said sensor, thereby rendering said sensor turned on, so that said sensor detects that a process cartridge containing color toner is mounted to said mounting means.

19. The image forming apparatus according to claim 18, wherein said sensor is a photosensor; wherein the lever member includes an identification lever, and a supplemental lever having a shield portion; and wherein, when the identification lever rotates upon contact with the grip member, the identification lever contacts the supplemental lever, thereby rotating the supplemental lever, and thereby causing the shield portion to come out of a light path to said sensor to turn on said sensor, so that said sensor produces a signal informing that the process cartridge containing color toner is mounted to said mounting means.

20. The image forming apparatus according to one of claims 16, 17, or 19, wherein said controlling means, in a case that said sensor detects that the process cartridge containing the black toner has been mounted to the image forming apparatus body, selects an image forming condition to reduce DC voltage for development bias to be applied to the developing means and to reduce a fixing temperature of fixing means in comparison with a case that the process cartridge containing the color toner is mounted.

21. The image forming apparatus according to claim 20, wherein said controlling means includes a CPU, a RAM, and a ROM, receives a signal from said sensor, and selects the image forming condition according to the existence or non-existence of the signal.

22. The image forming apparatus according to one of claims 16, 17, or 18, wherein said image forming apparatus body includes a first body having said fixing means, and a second body having said mounting means and being openable relative to said first body, and wherein the process cartridge mounted to said mounting means is mounted to an image forming position of said image forming apparatus body by closing said second body with respect to said first body.

23. An image forming apparatus for forming an image on a recording medium, and to which a process cartridge is detachably mountable, said image forming apparatus comprising:

a. a mounting member for detachably mounting a process cartridge which has a cartridge frame, an electrophotographic photosensitive drum, a charging roller for charging the electrophotographic photosensitive drum, a developing roller for feeding toner to the electrophotographic photosensitive drum in order to develop a latent image formed on the electrophotographic photosensitive drum, a cleaning blade for removing toner remaining on the electrophotographic photosensitive drum, a toner container for containing toner used by the developing roller to develop the latent image formed on the electrophotographic photosensitive drum, a grip member disposed on the cartridge frame with an attachment angle corresponding to a kind of toner contained in the toner container to select an image forming condition in accordance with whether the kind of toner contained in the toner container is black toner or is color toner, when the process cartridge is mounted to an image forming apparatus body of said image forming apparatus, wherein the grip member is disposed with an inclination relative to a substantially vertical direction when the process cartridge is mounted to an image forming position in said image forming apparatus body in a case that the kind of toner contained in the toner container is black toner, and wherein the grip member is disposed to extend in the substantially vertical direction when the process cartridge is mounted to the image forming position in said image forming apparatus body in a case that the kind of toner contained in the toner container is color toner;

b. a detecting member having a lever member disposed so as to not contact the grip member disposed with the inclination relative to the substantially vertical direction, and so as to contact the grip member disposed to extend in the substantially vertical direction when the process cartridge is mounted to said image forming apparatus body in order to detect as to whether the process cartridge mounted to said mounting member is a process cartridge in which the toner container contains black toner or a process cartridge in which the toner container contains color toner, and having a photosensor that may be turned on and off in accordance with the kind of toner contained in the toner container, wherein the grip member disposed with the inclination relative to the substantially vertical direction does not contact the lever member thereby rendering the photosensor turned off, and wherein the grip member disposed to extend in the substantially vertical direction contacts the lever member thereby rotating the lever member to turn the photosensor on;

c. a controller for detecting that a process cartridge containing black toner has been mounted to said image forming apparatus body when the photosensor is turned off, for detecting that a process cartridge containing color toner has been mounted to said image forming apparatus body when the photosensor is turned on, for selecting, when the sensor detects that a process cartridge containing black toner has been mounted to said image forming apparatus body, an image forming condition to reduce DC voltage for development bias to be applied to the developing roller and to reduce a fixing temperature of a fixing member in comparison with a case that a process cartridge containing color toner is mounted, and for forming the image under the selected image forming condition;

d. a transfer roller for transferring a toner image formed on the electrophotographic photosensitive drum of the process cartridge mounted to said mounting member, onto the recording medium;

e. a fixing member for fixing to the recording medium the toner image transferred by said transfer roller onto the recording medium; and f. a conveying member for conveying the recording medium.

24. The image forming apparatus according to claim 23, wherein the lever member includes an identification lever and a supplemental lever having a shield portion; and wherein, when the identification lever rotates upon contact with the grip member, the identification lever contacts the supplemental lever, thereby rotating the supplemental lever, and thereby causing the shield portion to come out of a light path to the photosensor to turn on the photosensor, so that the photosensor produces a signal informing that the process cartridge containing color toner is mounted to said mounting member.

25. The image forming apparatus according to claim 23; wherein said controller includes a CPU, a RAM, and a ROM, receives a signal from the photosensor, and selects the image forming condition according to the existence or non-existence of the signal.

26. The image forming apparatus according to claim 23, wherein said image forming apparatus body includes a first body having said fixing member, and a second body having said mounting member and being openable relative to said first body, and wherein the process cartridge mounted to said mounting member is mounted to the image forming position by closing said second body with respect to said first body.

27. An image forming apparatus for forming an image on a recording medium, and to which a process cartridge is detachably mountable, said image forming apparatus comprising:

a. mounting means for detachably mounting a process cartridge having a cartridge frame, an electrophotographic photosensitive drum, developing means for developing a latent image formed on the electrophotographic photosensitive drum, a toner container for containing toner used by the developing means to develop the latent image formed on the electrophotographic photosensitive drum, and a grip member disposed on the cartridge frame with an attachment angle corresponding to a type of the toner contained in the toner container, the attachment angle being used to select an image forming condition according to the type of toner contained in the toner container when the process cartridge is mounted to an image forming apparatus body of said image forming apparatus;

b. a sensor for detecting the attachment angle of the grip member of the process cartridge mounted to said mounting means;

c. controlling means for selecting the image forming condition in association with a detection result of said sensor, and for forming an image with the selected image forming condition;

d. fixing means for fixing onto the recording medium a toner image that is formed on the electrophotographic photosensitive drum of the process cartridge mounted to said mounting means and is transferred to the recording medium; and, e. conveying means for conveying the recording medium, wherein said controlling means, in a case that said sensor detects that a process cartridge containing black toner has been mounted to said image forming apparatus body, selects an image forming condition to reduce DC voltage for development bias to be applied to the developing means and to reduce a fixing temperature of said fixing means in comparison with a case that a process cartridge containing color toner is mounted.

28. The image forming apparatus according to claim 27, wherein said controlling means includes a CPU, a RAM, and a ROM, receives a signal from said sensor, and selects the image forming condition according to the existence or non-existence of the signal.

29. An image forming apparatus for forming an image on a recording medium, and to which a process cartridge is detachably mountable, said image forming apparatus comprising:

a. mounting means for detachably mounting a process cartridge having a cartridge frame, an electrophotographic photosensitive drum, developing means for developing a latent image formed on the electrophotographic photosensitive drum, a toner container for containing toner used by the developing means to develop the latent image formed on the electrophotographic photosensitive drum, and a grip member disposed on the cartridge frame with an attachment angle corresponding to a type of the toner contained in the toner container, the attachment angle being used to select an image forming condition according to the type of toner contained in the toner container when the process cartridge is mounted to an image forming apparatus body of said image forming apparatus;

b. a sensor for detecting the attachment angle of the grip member of the process cartridge mounted to said mounting means;

c. controlling means for selecting the image forming condition in association with a detection result of said sensor, and for forming an image with the selected image forming condition;

d. fixing means for fixing onto the recording medium a toner image that is formed on the electrophotographic photosensitive drum of the process cartridge mounted to said mounting means and is transferred to the recording medium; and e. conveying means for conveying the recording medium, wherein said image forming apparatus body includes a first body having said fixing means, and a second body having said mounting means and being openable relative to said first body, and wherein the process cartridge mounted to said mounting means is mounted to an image forming position of said image forming apparatus body by closing said second body with respect to said first body.

30. An image forming apparatus for forming an image on a recording medium, and to which a process cartridge is detachably mountable, said image forming apparatus comprising:

a. mounting means for detachably mounting a process cartridge having a cartridge frame, an electrophotographic photosensitive drum, developing means for developing a latent image formed on the electrophotographic photosensitive drum, a toner container for containing toner used by the developing means to develop the latent image formed on the electrophotographic photosensitive drum, and a grip member disposed on the cartridge frame with an attachment angle corresponding to a type of the toner contained in the toner container, the attachment angle being used to select an image forming condition according to the type of toner contained in the toner container when the process cartridge is mounted to an image forming apparatus body of said image forming apparatus;

b. a sensor for detecting the attachment angle of the grip member of the process cartridge mounted to said mounting means, said sensor including a photosensor;

c. controlling means for selecting the image forming condition in association with a detection result of said sensor, and for forming an image with the selected image forming condition;

d. fixing means for fixing onto the recording medium a toner image that is formed on the electrophotographic photosensitive drum of the process cartridge mounted to said mounting means and is transferred to the recording medium; and e. conveying means for conveying the recording medium, wherein, when the process cartridge is mounted to said mounting means at an image forming position, the grip member is disposed so as to extend in a substantially vertical direction in a case that the type of toner contained in the toner container of the process cartridge is color toner, wherein, when the process cartridge is mounted to the image forming position, the grip member, disposed so as to extend in a substantially vertical direction, contacts a lever member that includes an identification lever, and a supplemental lever having a shield portion, and wherein, when the identification lever rotates upon contact with the grip member, the identification lever contacts the supplemental lever, thereby rotating the supplemental lever, and thereby causing the shield portion to come out of a light path to said sensor to turn on said sensor, so that said sensor produces a signal informing that the process cartridge containing color toner is mounted to said mounting means.

* * * * *

UNITED STATES PATENT AND TRADEMARK OFFICE

CERTIFICATE OF CORRECTION

PATENT NO. : 5,768,659

DATED : June 16, 1998

INVENTOR(S) : SEIICHIRO KAMEDA

It is certified that error appears in the above-identified patent and that said Letters Patent is hereby corrected as shown below:

COLUMN 2

Figure 16B:
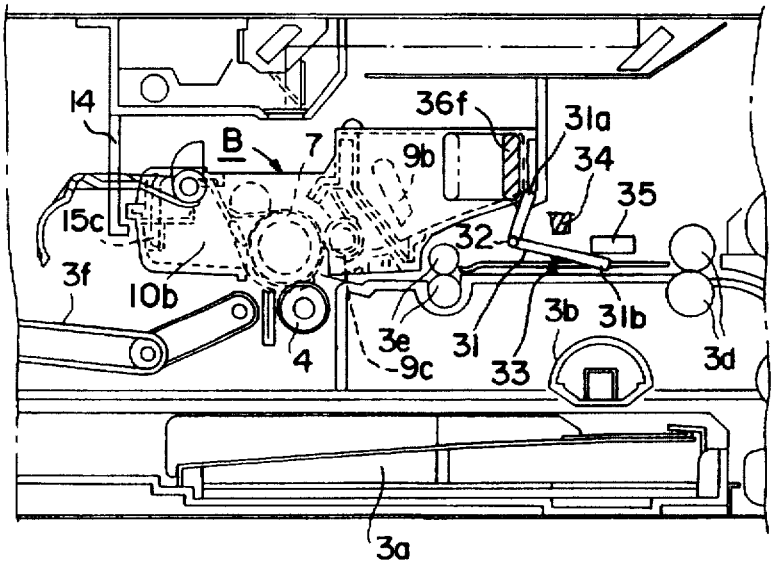

Line 21, "FIGS. 6(A)" should read --FIGS. 6(a)--.
Line 24, "FIGS. 7(A)" should read --FIGS. 7(a)--.
Line 26, "FIGS. 8(A)" should read --FIGS. 8(a)--.
Line 38, "FIGS. 15(A)" should read --FIGS. 15(a)--.
Line 41, "FIG. 16 is an illustration" should read --FIGS. 16(a) and 16(b) are illustrations--.
Line 45, "FIG. 17 is an illustration" should read --FIGS., 17(a) and 17(b) are illustrations--.

COLUMN 4

Line 44, "6(A)," should read --6(a),--; and "7(A)" should read --7(a)--.
Line 64, "contact to" should read --contact--.

COLUMN 5

Line 9, "lever 17" (second occurrence) should read --lever 21--.
Line 51, "made of" should be deleted.
Line 53, "RAM 24a" should read --RAM 24c--.

COLUMN 6

Line 33, "FIGS. 8(A)" should read --FIGS. 8(a)--.
Line 38, "FIGS. 8(A)" should read --FIGS. 8(a)--.

UNITED STATES PATENT AND TRADEMARK OFFICE

CERTIFICATE OF CORRECTION

PATENT NO. : 5,768,659

DATED : June 16, 1998

INVENTOR(S) : SEIICHIRO KAMEDA

It is certified that error appears in the above-identified patent and that said Letters Patent is hereby corrected as shown below:

COLUMN 7

Line 25, "15(A)" should read --15(a)--.
Line 58, "15(A)" should read --15(a)--; and "used" should read --are used--.
Line 60, "the cartridge" should read --cartridge--.

COLUMN 8

Line 10, "interfere" should read --interfere with--.
Line 52, "embodiment" should read --embodiments--.
Line 57, "FIGS. 16(A)" should read --FIGS. 16(a)--.
Line 63, "interfere" should read --interfere with--.

COLUMN 9

Line 12, "as" should read --as in--.
Line 23, "as" should read --as in--.
Line 24, "FIGS. 17(A)" should read --FIGS. 17(a)--.
Line 52, "as" should read --as in--.

UNITED STATES PATENT AND TRADEMARK OFFICE

CERTIFICATE OF CORRECTION

PATENT NO. : 5,768,659

DATED : June 16, 1998

INVENTOR(S) : SEIICHIRO KAMEDA

It is certified that error appears in the above-identified patent and that said Letters Patent is hereby corrected as shown below:

COLUMN 15

Line 44, "claim 23;" should read --claim 23,--.

Signed and Sealed this

Sixteenth Day of February, 1999

*Attest:*

*Attesting Officer*

*Acting Commissioner of Patents and Trademarks*